US005082153A

United States Patent [19]

Duester et al.

[11] Patent Number: 5,082,153

[45] Date of Patent: * Jan. 21, 1992

[54] GARMENT CLAMPING HANGER

[75] Inventors: Everett L. Duester; Russell O. Blanchard, both of Zeeland; Harley Brower, Grandville, all of Mich.

[73] Assignee: Batts, Inc., Zeeland, Mich.

[ * ] Notice: The portion of the term of this patent subsequent to Apr. 21, 2006 has been disclaimed.

[21] Appl. No.: 276,761

[22] Filed: Nov. 7, 1988

Related U.S. Application Data

[63] Continuation of Ser. No. 128,205, Dec. 3, 1987, abandoned.

[51] Int. Cl.[5] ..... A47G 25/48; A47G 25/14

[52] U.S. Cl. ..... 223/96; 223/95; 223/91; 223/93; 223/90; 24/545; D6/326

[58] Field of Search ..... 223/90, 91, 93, 96, 223/95; 86/326; 24/500, 501, 545, 547, 562, 564

[56] References Cited

U.S. PATENT DOCUMENTS

| | | | |
|---|---|---|---|
| 2,471,606 | 5/1949 | Burns | 24/501 |
| 2,849,168 | 8/1958 | Boyer | 223/91 |
| 3,047,196 | 7/1962 | Levine et al. | 223/96 |
| 3,225,978 | 12/1965 | Wach | 223/91 |
| 3,406,883 | 10/1968 | Crane | 223/96 |
| 3,767,092 | 10/1973 | Garrison et al. | 223/96 |
| 4,023,721 | 5/1977 | Erthein | 24/564 X |
| 4,194,274 | 3/1980 | Garrison | 24/562 X |
| 4,658,996 | 4/1987 | Warmath | 24/562 X |
| 4,716,634 | 1/1988 | Fan | 223/91 X |

FOREIGN PATENT DOCUMENTS

| | | | |
|---|---|---|---|
| 0095353 | 11/1983 | European Pat. Off. | 223/91 |
| 012840 | 9/1956 | Fed. Rep. of Germany | 24/501 |
| 1514679 | 6/1978 | United Kingdom | 223/96 |

*Primary Examiner*—Werner H. Schroeder
*Assistant Examiner*—Bibhu Mohanty
*Attorney, Agent, or Firm*—Price, Heneveld, Cooper, DeWitt & Litton

[57] ABSTRACT

A garment hanger of the garment clamping type has a pair of jaws, the first one of which is integral with the hanger body and the other is pivotal about the top of the first jaw. A resilient clip slidably seated over the tops of the jaws resiliently holds the jaws in garment clamping position. The front face of the pivoted jaw has an elongated recessed channel to guide the user's finger to engage the clip and slide it into release position. The jaws are so designed that the free end of the pivoted jaw can pass a limited distance through the bottom of the first jaw when no garment is present.

4 Claims, 2 Drawing Sheets

GARMENT CLAMPING HANGER

This is a continuation of copending application Ser. No. 128,205, filed on Dec. 3, 1987, now abandoned.

FIELD OF THE INVENTION

This invention relates to garment hangers and more particularly to garment hangers of the type having a pair of hinged jaws which, by means of a resilient, sliding element, are caused to resiliently clamp a garment.

BACKGROUND OF THE INVENTION

Garment hangers equipped with clamps hingedly joined together at their upper ends and resiliently urged into closed position to grip the garment have been known for a number of years. The basic concept of this type of hanger is disclosed in U.S. Pat. No. 3,767,092 entitled GARMENT CLAMPING HANGER WITH SLIDABLE LOCKING CLIP granted Oct. 23, 1973 to Judd F. Garrison et al. The present invention constitutes an improvement over the basic clamping hanger construction disclosed in that patent. It is designed to provide a clamp which will effectively grip garments of a wider range of designs, sizes and weights. It is also designed to overcome the problem which has been experienced by some operators of difficulty in manipulating the locking clip. This has been the source of some difficulty inasmuch as the clip must be relatively strong and resistant to sliding movement in order to provide sufficient clamping pressure to assure a positive grip on the garment. Also, some operators, particularly women, have experienced nail breakage in attempting to release the locking clip in existing clamping hangers of this type.

BRIEF DESCRIPTION OF THE INVENTION

The invention provides a garment clamp so designed that the operator's finger used to raise and release the resilient clamping member is automatically guided to the proper position to effect this operation. In so doing, the operator is largely protected from such problems as breaking fingernails or otherwise making an incorrect contact with the sliding clamp. Further, this invention provides an automatic guidance system for the operator's finger so that the operator does not have to concentrate on proper location of the finger when manipulating the clamp and, thus, can give greater attention to the garment. This is advantageous to sales personnel because it permits them to divert more of their attention to the customer rather than to the mechanical maneuvers necessary to release the garment from the hanger. These and other objects and purposes of the invention will be understood by those familiar with the design and use of garment hangers upon reading the following specification and the accompanying drawings.

IN THE DRAWINGS

DESCRIPTION OF THE PREFERRED EMBODIMENT

Figure 1:
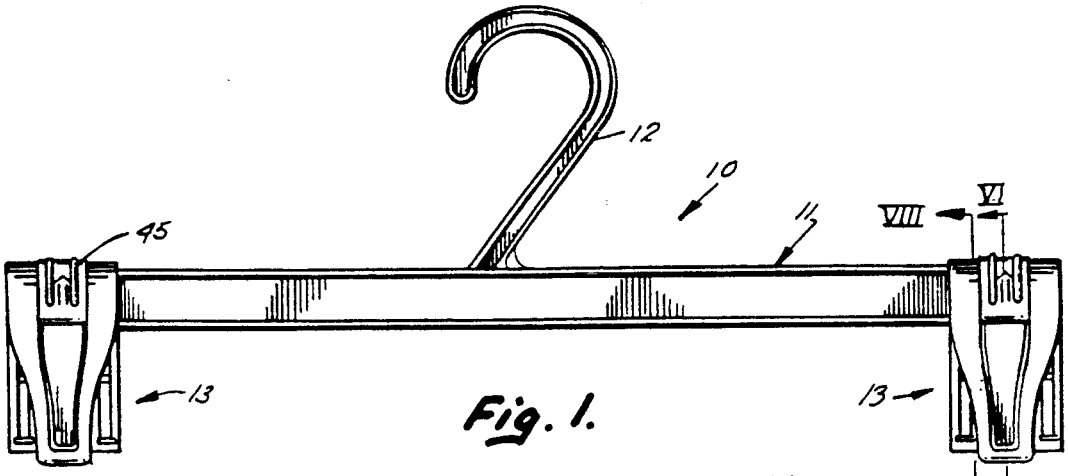
FIG. 1 is a front elevation view of a hanger incorporating this invention.
Figure 2:
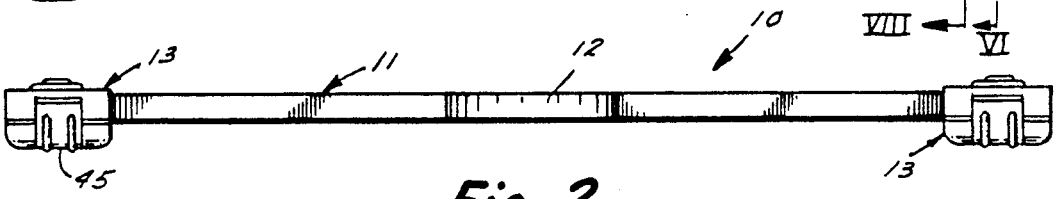
FIG. 2 is a top plan view of the hanger illustrated in FIG. 1.
Figure 3:
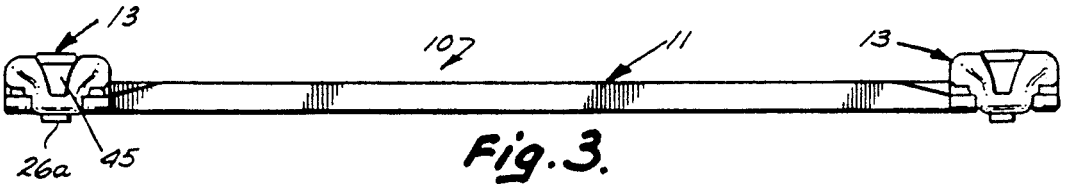
FIG. 3 is a bottom view of the hanger illustrated in FIG. 1.
Figure 4:
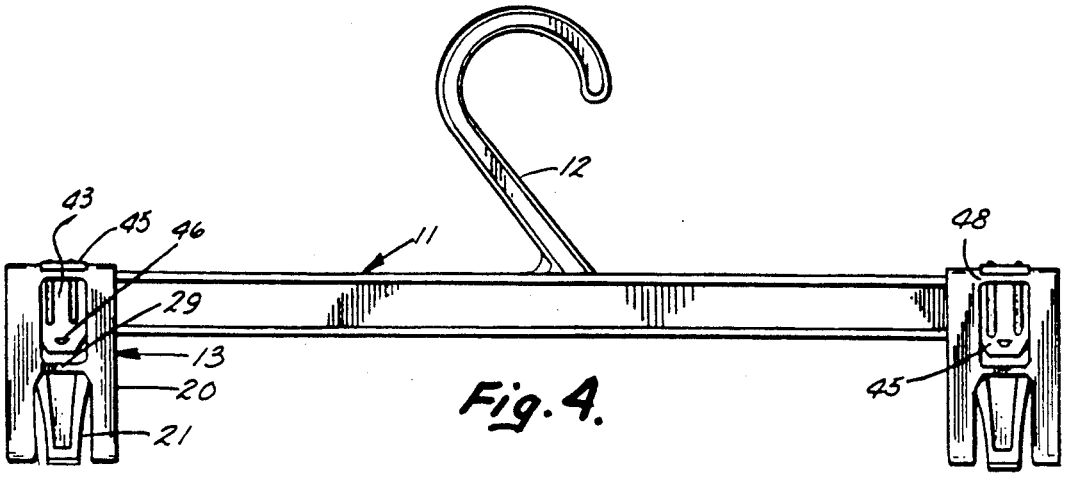
FIG. 4 is a rear elevation view of the hanger illustrated in FIG. 1.
Figure 10:
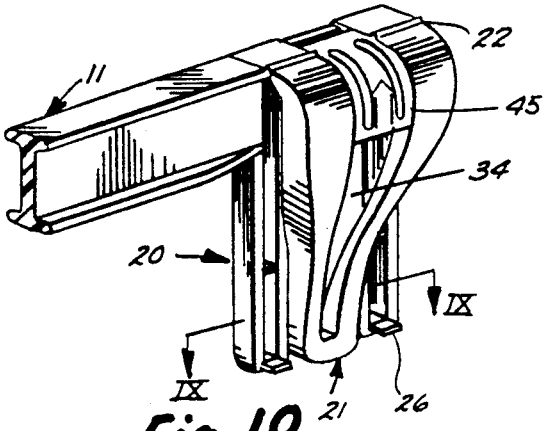
FIG. 10 is an oblique, fragmentary view of one end of the hanger illustrating the clamp in closed position.
Figure 5:
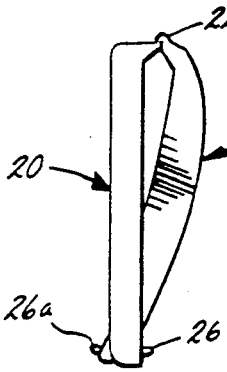
FIG. 5 is an end view of one of the clamps of the hanger.
Figure 7:
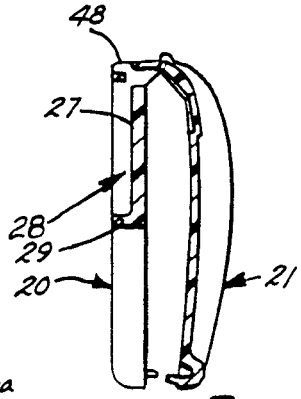
FIG. 7 is a view similar to FIG. 6 with the spring locking clip removed.
Figure 8:
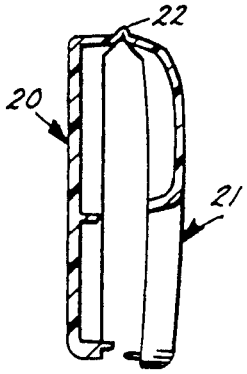
FIG. 8 is a sectional elevation view taken along the plane VIII—VIII of FIG. 1.
Figure 11:
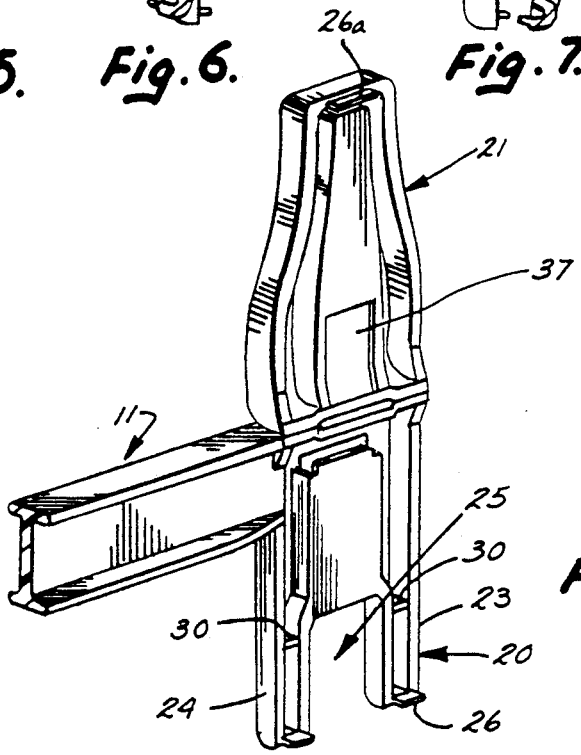
FIG. 11 is a view similar to FIG. 10 illustrating the clamp with the locking clip removed and the clamp opened to exhibit its internal structure.

Referring to FIG. 1, numeral 10 identifies a hanger having a body 11 which is essentially an elongated beam supported at the center by a hook 12 and having a clamp member 13 at each end. The clamp members are identical and, therefore, the description of one will be sufficient for both. Each of clamps consists of a rear jaw 20 and a front jaw 21. The jaws are connected at the top by a thin web 22 (FIG. 5) which serves as a hinge about which the front jaw 21 can be pivoted with respect to the rear jaw 20. The jaws are molded as a single integral component from a suitable plastic. They are also integral with the body 11 and are therefore, molded simultaneously with the body 11 from a suitable plastic, such as polypropylene. As is best seen in FIG. 11, the rear jaw or panel of the clamp has a pair of vertical side members 23 and 24. The lower portion of the rear jaw is bifurcated by a generally rectangular opening 25 whereby the lower portions of the side members 23 and 24 become, in effect, rear legs of generally U-shaped cross section. The lower ends of the side members 23 and 24 have garment gripping members 26. The center portion 27 of the upper part of the rear jaw is offset forwardly to provide a track or channel 28 for the hereinafter to be described as a resilient clip (FIG. 7). The lower end of the channel 28 is terminated by a cross member 29 which separates the end of the channel from the opening 25 (FIG. 7). It also serves the purpose of reinforcing and stiffening the side members 23 and 24. The side members are also further stiffened by the ribs 30. The rear jaw is basically rectangular since its sides are parallel and its width is constant throughout its length.

Figure 9:
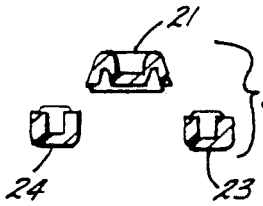
FIG. 9 is a sectional view taken along the plane IX—IX of FIG. 10.
Figure 6:
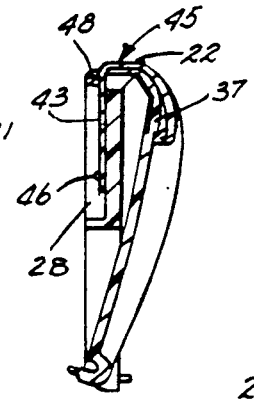
FIG. 6 is a sectional elevation view taken along the plane VI—VI of FIG. 1.

The front jaw has an elongated, central, recessed channel 34 which extends all of the way from the hinge at the top to almost the very bottom of the jaw. The upper portion of the channel is wider than the lower portion and for a short distance is of uniform width to provide a space in which the locking clip 45 can slide. The bottom of the channel is flat and the sides have a slight outward taper, just enough to permit the molded clamp to be easily released from its mold. From a point which is approximately one-third of the height of the jaw from the bottom, the channel progressively widens until it reaches a point approximately two-thirds the distance above the bottom of the jaw where the side walls become parallel. In this portion, the channel has a raised panel 37 (FIG. 7) which serves as a stop for the locking clip when it is shifted to fully locked position (FIG. 6). The lower end of the raised panel 37 forms a shallow step which acts to resist upward or release movement of the locking clip unless the locking clip is subjected to intentional and positive upward movement. The lower end of the locking clip 45 has an inturned end which facilitates contact by the operator and acts as a catch seating over the lower edge of the panel 37. Between the channel 34 and the outer edges of the front jaw, the web of the jaw is offset forwardly, thereby, providing not only the sides of the channel but also providing the sides of the entire front jaw. Thus, as will be clearly seen from FIGS. 9 and 11, the jaw is so configured structurally that it is highly resistant to any deflection. This is important in providing a positive grip on any garments with which the hanger is used. In this connection, the extended central channel 34 provides a strong twist and deflection-resistant, beam-like structure which serves both the purpose of facilitating the use of the hanger and also giving the front jaw a very rigid and load resisting structure. This is particularly true as the lower portion of the front jaw becomes narrower. The jaw has a particularly high polar moment of inertia which resists both bending and twisting and, thereby, can be depended upon to positively support even heavy and bulky garments.

The lower portion is so designed that it will pass through the opening 25. In the preferred construction, the rear face of the recessed portion of the front jaw is in the same plane as the rear ends of the side walls of the jaw. By narrowing the width of the lower portion of the front jaw such that it will pass through the opening 25, the clamp will have substantial clamping pressure on a garment even though the garment is quite thin. This provides a structure which will positively hold the garment even under conditions of continuing vibration or improper mounting of the garment within the clamp.

The clamp is held in closed position by the locking clip 45. The clip has a forward leg and a rearward leg. The length of the forward leg is such that it slides down the forward channel far enough pass to the inturned end over the end of the panel 37 with the rolled end of the clip cooperating with the lower end of the panel to provide a positive stop against the clip being unintentionally urged upwardly into released position as a result of its own resilience. The clip extends over the top of the clamp and has a rear leg 43 which is substantially longer than the front leg. The rear leg is slidably mounted in the channel 28 in the rear face of the rear panel. In doing so, the clip passes through a slot formed by the bridge 48 at the top of the channel. Preferably, the clip has a rearwardly extending stop 46 which engages the bridge 48 to prevent the clip from being completely released from the hanger when it is pushed into released position. The clip incorporates the construction disclosed in U.S. Pat. No. 3,767,092 to which reference is made above. Once again, however, the structure of the channel in which the rear leg of the clip slides provides a strong, deflection resisting recess in the rear panel which provides the rear panel with a polar moment of inertia resisting twisting or other structural deflection. Also, the width of both the front and rear channels is such as to positively confine and guide the clip.

By adding to the length of the clamp, it is possible with most garments to entirely enclose the hem or waistband portion at the top of the garment in the pocket formed between the jaws. Thus, the garment grippers 26 which extend from the bottoms of the rear jaw side members 23 and 24 and the grip 26*a* which extends from the front jaw can seat under the belt or thickened top portion of the garment and positively hold it against release even under severe conditions. Because of this additional length of the jaws, it is necessary to provide additional rigidity and strength to the jaws so that they will not simply deflect under the resistance of the garments sufficiently to release the garment inadvertently. This is accomplished by the cross-sectional configuration as previously explained.

It will be observed from FIG. 11 that a hanger such as illustrated in FIGS. 1–4 can be molded with the clamps and the body 11 as a single, integral piece without the necessity of any special movable parts in the mold because the part will be automatically released simply by the separation of a two-part mold. This not only reduces the initial cost of the molds but also makes it possible to operate the molding equipment at a higher rate of speed and, therefore, in a more economical manner. It will also be recognized that while an I-beam type of body structure has been shown for the beam 11, other shapes could be utilized with equal facility without adversely affecting both the functional characteristics of the hanger or the cost of its manufacture. At the same time, it is not necessary that the hook be an integral part of the molded body, since a conventional wire hook could be substituted without in any way changing the principles of the invention.

Because of the design and shape of the front jaw with the channel serving as a finger guide, it is unnecessary for the operator to utilize more than one hand to effectively release the garment from one of the clamps. This is particularly important for sales clerks and people in a similar position to facilitate the handling of the garment when it is being displayed to a customer.

Having described a preferred embodiment of our invention, it will be recognized that modifications of our preferred embodiment can be made without departing from the principles of this invention. Such modifications are to be considered as included within the hereinafter appended claims, unless these claims by their language expressly state otherwise.

We claim:

1. A garment clamp for a hanger having a rear jaw and a front jaw, said jaws being hingedly joined at their upper ends, said front and rear jaws having an aligned channel formed in their outer faces, a resilient U-shaped closure member seated in said channel having a rear leg portion movable lengthwise of said channel in said rear jaw and a front leg movable lengthwise of said channel in said front jaw, said front leg portion extending a minor portion of the length of said channel in said front jaw; said channel in said front jaw being recessed into the front face of said front jaw and extending substantially the full length of said front jaw and serving as a guide for a finger being moved lengthwise of said jaw toward said closure member; said channel from a point substantially midway between its lower end and the end of the front leg portion of said closure member progressively widening to the width of said closure member both to guide a operator's finger toward said closure member and to permit the operator's finger to move rearwardly into said channel as it approaches the lower end of said closure member, and wherein the rear leg of said clamp is of uniform width through its length, an opening in and through said rear leg extending from the lower end of said rear leg approximately half the height thereof, said opening being flanked on each side by a depending leg member, said leg member being spaced apart a distance such that the lower portion of said front jaw can pass between them.

2. A hangar having an elongated body member and a garment clamp, said clamp having a rear jaw and a front jaw, said jaws being of substantially the same length, said rear jaw being integral with said body member and said front jaw being hingedly joined to said rear jaw at its upper end, said front and rear jaws being elongated and each having a channel formed in tis outer face, a resilient U-shaped closure member slidably seated in said channels and having a rear leg portion movable lengthwise of said channel in said rear jaw and a front leg portion movable lengthwise of the upper portion of said channel in said front jaw, said front leg portion extending a minor portion of the length of said channel in said front jaw; said channel in said front jaw being recessed into the front face of said front jaw and extending from its upper end substantially the full length of said front jaw and serving as a guide for a finger being moved upwardly lengthwise of said jaw toward said closure member; said front channel from a point substantially midway between its lower end and the end of the front leg portion of said closure member progressively widening to the width of that of said closure member to guide a operator's finger toward said closure member and to permit the operator's finger to move rearwardly into said channel as it approaches the lower end of said closure member; the rear leg of said clamp being of uniform width throughout its length, an opening in and through said rear leg extending from the lower end of said rear leg approximately half the height thereof, said opening being flanked on each side by a depending leg member, said leg members being spaced apart a distance such that the lower portion of said front jaw can pass between them, said legs at their upper ends being joined by a cross bar, said cross bar defining the lower end of said channel in said rear leg portion.

3. A hanger having an elongated body member and a garment clamp, said clamp having a rear jaw and a front jaw, said jaws being of substantially the same length, said rear jaw being integral with said body member and said front jaw being hingedly joined to said rear jaw at its upper end, said front and rear jaws being elongated and each having a channel formed in its outer face, a resilient U-shaped closure member slidably seated in said channels and having a rear leg portion movable lengthwise of said channel in said rear jaw and a front leg portion movable lengthwise of the upper portion of said channel in said front jaw, said front leg portion extending a minor portion of the length of said channel in said channel in said front jaw; said channel in said front jaw being recessed into the front face of said front jaw and extending from its upper end substantially the full length of said front jaw and serving as a guide for a finger being moved upwardly lengthwise of said jaw toward said closure member; the lower portion of said front channel being narrower than a operator's finger but wide enough to receive a sufficient portion of the operator's finger to provide a positive guide therefor as it is moved upwardly toward said closure member, said channel from a point substantially midway between its lower end and the end of the front leg portion of said closure member progressively widening to a width which permits the operator's finger to progressively shift rearwardly into the channel to seat on the floor of the channel, said width of the upper portion of said channel being that of said closure member and thereafter maintaining said width to said hinged joinder of said jaws to positively guide the operator's finger both in upward movement as the closure is moved upwardly to release position; said rear jaw of said clamp being of uniform width throughout its length and having an opening in and through said rear jaw extending from the lower end of said rear jaw up to and no more than approximately half the height thereof and below the end of said closure member when said closure member is seated in full clamp closure position, the sides of said opening being defined by a pair of depending spaced legs between which the lower portion of said front jaw can pass, said legs at their upper ends being joined by a cross bar defining the lower end of said channel in said rear jaw.

4. A hanger having an elongated body member and a garment clamp, said clamp having a rear jaw and a front jaw, said jaws being of substantially the same length, said rear jaw being integral with said body member and said front jaw being hingedly joined to said rear jaw at its upper end, said front and rear jaws being elongated and each having a channel formed in its outer face, a resilient U-shaped closure member slideably seated in said channels and having a rear leg portion movable lengthwise of said channel in said rear jaw and a front leg portion movable lengthwise of the upper portion of said channel in said front jaw, said front leg portion extending a minor portion of the length of said channel in said front jaw; said channel in said front jaw being recessed into the front face of said front jaw and extending from its upper end substantially the full length of said front jaw and serving as a guide for a finger being moved upwardly lengthwise of said jaw toward said closure member; said channel at least from a point substantially midway between its lower end and the end of the front leg portion of said closure member having a width substantially the same as the width of said closure member and which permits the operator's finger to shift rearwardly into the channel to seat on the floor of the channel to positively guide an operator's finger in its upward movement as the closure is moved upwardly to a release position; said rear jaw of said clamp being of uniform width throughout its length and having an opening in and through said rear jaw extending from the lower end of said rear jaw less than approximately half the height thereof and below the end of said closure member when said closure member is seated in full clamp closure position, the sides of said opening being defined by a crossbar and a pair of depending spaced legs between which the lower portion of said front jaw can pass, said legs being joined only by said crossbar defining the lower end of said channel in said rear jaw.

* * * * *

UNITED STATES PATENT AND TRADEMARK OFFICE

CERTIFICATE OF CORRECTION

PATENT NO. : 5,082,153

DATED : January 21, 1992

INVENTOR(S) : Everett L. Duester, et. al

It is certified that error appears in the above-indentified patent and that said Letters Patent is hereby corrected as shown below:

Column 5, Claim 2, Line 7, "tis" should be --its--.

Signed and Sealed this

Seventeenth Day of August, 1993

Bruce Lehman

*Attest:*

BRUCE LEHMAN

*Attesting Officer*

*Commissioner of Patents and Trademarks*